US011805836B2

(12) United States Patent
Kaye et al.

(10) Patent No.: US 11,805,836 B2
(45) Date of Patent: Nov. 7, 2023

(54) HEADLAMP HAVING A DETACHABLE FLASHLIGHT

(71) Applicant: LB Marketing, Inc., Alpharetta, GA (US)

(72) Inventors: Douglas R. Kaye, Alpharetta, GA (US); Kevin Joseph Brown, Alpharetta, GA (US); Harold Morrison Barber, Jr., Alpharetta, GA (US); Elvis Perez, Alpharetta, GA (US)

(73) Assignee: LB MARKETING, INC., Alpharetta, GA (US)

( * ) Notice: Subject to any disclaimer, the term of this patent is extended or adjusted under 35 U.S.C. 154(b) by 0 days.

(21) Appl. No.: 17/731,650

(22) Filed: Apr. 28, 2022

(65) Prior Publication Data

US 2022/0248790 A1 Aug. 11, 2022

Related U.S. Application Data

(63) Continuation of application No. 17/139,307, filed on Dec. 31, 2020, now Pat. No. 11,317,671, which is a (Continued)

(51) Int. Cl.

*A42B 1/244* (2021.01)
*F21L 4/02* (2006.01)

(Continued)

(52) U.S. Cl.

CPC ..... *A42B 1/244* (2013.01); *F21L 4/022* (2013.01); *F21V 21/096* (2013.01); *F21V 21/0965* (2013.01); *F21V 23/0414* (2013.01)

(58) Field of Classification Search

CPC ..... A42B 1/244; A42B 3/044; A42B 3/0446; F21L 4/022; F21L 4/02; F21V 21/096;

(Continued)

(56) References Cited

U.S. PATENT DOCUMENTS 3,601,595 A 8/1971 Kivela
4,462,064 A 7/1984 Schweitzer (Continued)

FOREIGN PATENT DOCUMENTS

CN 102192465 A 9/2011
GB 2538939 A 12/2016

OTHER PUBLICATIONS

Amazon.com, "Dorcy Pro Series 200-Lumen Weather Resistant LED Magnetic Headlight," https://www.amazon.com/Dorcy-200-Lumen-Resistant-Headlight-41-2614/dp/B00YCKX7TK (last visited: Aug. 13, 2018).

(Continued)

*Primary Examiner* — Peggy A Neils

(74) *Attorney, Agent, or Firm* — Thomas Horstemeyer, LLP

(57) ABSTRACT

Various embodiments for a headlamp having a detachable flashlight are disclosed. The headlamp includes a head guard and a detachable flashlight. The head guard is adapted to be worn on a head of an operator, and includes a first battery, a first electrical contact, and a first magnet. The detachable flashlight is configured to detachably attach to the head guard, and includes a second battery, a second electrical contact and a second magnet. When the second magnet is positioned near the first magnet, the detachable flashlight magnetically couples to the head guard and aligns the second electrical contact with the first electrical contact/The head guard includes processing circuitry configured to provide power to and charge the second battery of the detachable flashlight in an instance in which the detachable flashlight is coupled to the head guard.

17 Claims, 13 Drawing Sheets

Related U.S. Application Data continuation of application No. 16/811,153, filed on Mar. 6, 2020, now Pat. No. 10,881,160.

(60) Provisional application No. 62/815,773, filed on Mar. 8, 2019.

(51) Int. Cl.
*F21V 21/096* (2006.01)
*F21V 23/04* (2006.01)

(58) Field of Classification Search
CPC ..... F21V 21/0965; F21V 23/0414; F21V 33/0008; F21V 21/084
See application file for complete search history.

(56) References Cited

U.S. PATENT DOCUMENTS

| | | | | |
|---|---|---|---|---|
| 4,916,596 | A | 4/1990 | Sharrah et al. | |
| 6,575,587 | B2 | 6/2003 | Cramer et al. | |
| 7,281,826 | B2 | 10/2007 | Huang | |
| 7,549,770 | B2 | 6/2009 | Devaney et al. | |
| 7,635,195 | B2 | 12/2009 | Tarter | |
| 8,038,311 | B2 | 10/2011 | Lau | |
| 8,113,681 | B2 | 2/2012 | Dallas et al. | |
| 8,117,676 | B1 * | 2/2012 | Cardoso | A42B 3/283 2/410 |
| 8,474,995 | B2 | 7/2013 | Lau | |
| 8,545,040 | B2 | 10/2013 | Berken | |
| 8,545,069 | B2 | 10/2013 | McCaslin et al. | |
| 8,662,699 | B2 | 3/2014 | Tarter | |
| 9,080,730 | B2 | 7/2015 | Popper et al. | |
| 9,163,793 | B2 | 10/2015 | Popper et al. | |
| 9,400,101 | B2 * | 7/2016 | Strong | F21V 29/61 |
| 9,829,182 | B1 | 11/2017 | McCaslin et al. | |
| 10,091,854 | B1 | 10/2018 | Brandon, II | |
| 10,215,383 | B2 | 2/2019 | Grider et al. | |
| 10,492,556 | B1 * | 12/2019 | Lee | F16B 47/00 |
| 10,881,160 | B2 | 1/2021 | Kaye et al. | |
| 2005/0174753 | A1 | 8/2005 | Cao et al. | |
| 2008/0253109 | A1 | 10/2008 | Canino et al. | |
| 2008/0298048 | A1 | 12/2008 | Garrity et al. | |
| 2009/0052181 | A1 | 2/2009 | Mao | |
| 2010/0053942 | A1 | 3/2010 | Tarter et al. | |
| 2012/0008309 | A1 | 1/2012 | Hale | |
| 2015/0285447 | A1 | 10/2015 | Inskeep | |
| 2017/0211759 | A1 | 7/2017 | Qiu | |
| 2017/0284646 | A1 | 10/2017 | Arena et al. | |
| 2018/0187869 | A1 | 7/2018 | Wiegel et al. | |
| 2018/0231234 | A1 | 8/2018 | Bian | |

OTHER PUBLICATIONS

Amazon.com, "NICRON Standalone Detachable Headlamp Flashlight," https://www.amazon.com/Flashlight-Standalone-Detachable-Rechargeable-flashlight/dp/B078NRW8PV (Publication Date Unknown) (last visited: May 8, 2020).

Amazon.com, "Remington High-performance 3AAA-size, 2-in-1 LED Flashlight," https://www.amazon.com/Remington-High-performance-3AAA-size-LED-Flashlight/dp/B001KYFZGO/ (Publication Date Unknown) (last visited: May 8, 2020).

Radiant 200 Collapsible Lantern+Flashlight https://www.niteize.com/product/Radiant-200-Collapsible-Lantern-Flashlight.asp (Publication Date Unknown) (last visited: May 8, 2020).

* cited by examiner

HEADLAMP HAVING A DETACHABLE FLASHLIGHT

CROSS-REFERENCE TO RELATED APPLICATION

This application is a continuation of U.S. patent application Ser. No. 17/139,307 entitled "HEADLAMP HAVING A DETACHABLE FLASHLIGHT," filed Dec. 31, 2020, which is a continuation of U.S. patent application Ser. No. 16/811,153 entitled "HEADLAMP HAVING A DETACHABLE FLASHLIGHT," filed Mar. 6, 2020 now U.S. Pat. No. 10,881,160, which claims the benefit of and priority to U.S. Provisional Patent Application No. 62/815,773 entitled "HEADLAMP HAVING A DETACHABLE FLASHLIGHT," filed Mar. 8, 2019, the contents of which being hereby incorporated by reference in their entireties herein.

BACKGROUND

Several forms of hand-free lighting exist. For instance, lighting devices are often found mounted on helmets or headbands, which prove useful in law enforcement, mining, construction, automotive, manufacturing, or other industries that frequently require hand-free lighting solutions. Existing lighting devices, however, generally include a lighting element that is fixed and not removable from a helmet, headband, or other device. Some removable lighting devices exist; however, these lighting devices are not suitable for hands-free operation and are often not easily removable or attachable to a helmet, headband, or other device.

For instance, U.S. Patent Application No. 2008/0298048 A1 to Garrity discusses a headlamp having a detachable light emitting diode (LED) flashlight and having a strap and a main body made of a flexible material. The flashlight comprises a body and a cap, where the cap is attached to the body by a strap. However, the flashlight of Garrity has a wide shape that is not optimal for hand-held operation, and attachment and removal from the strap and body is problematic and labor-intensive. Other deficiencies in the prior art will become apparent.

FIELD OF THE INVENTION

The present invention relates to a portable lighting device. More specifically, the present invention relates to a headlamp having a detachable flashlight capable of recharging.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
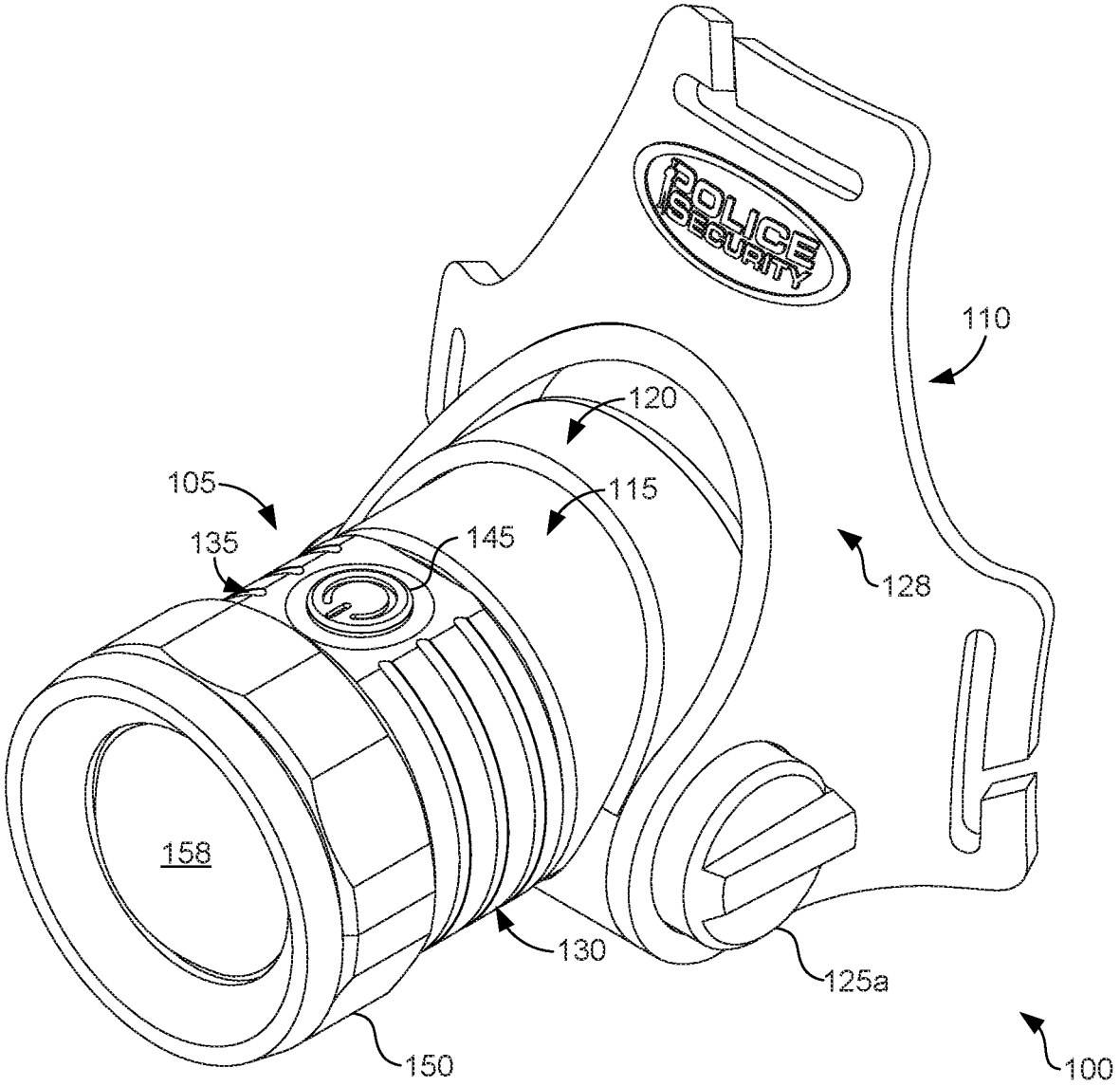
FIG. 1 is a top perspective view of a head guard with a detachable flashlight positioned therein in accordance with various embodiments of the present disclosure.

The present disclosure relates to a headlamp having a detachable flashlight. Existing hand-free illumination devices generally include a fixed lighting element that is not removable from a helmet or headband. While some devices include a removable lighting element, generally, these devices are not optimal for hand-free illumination. For instance, removal and reattachment of lighting elements in existing products can be time and labor intensive. Additionally, these lighting elements are not rechargeable. Providing a detachable and rechargeable lighting element that can be easily removed, attached, and secured to a helmet, headband, or other head-mounted device can present significant technical challenges.

Accordingly, in various embodiments of the present disclosure, a headlamp is described having a detachable flashlight. In some embodiments, the headlamp includes a head guard ergonomically contoured to be worn on a head of an operator, for instance, using one or more straps. The head guard can include a cavity, where the cavity includes at least a first electrical contact and a first magnet positioned therein. The detachable flashlight is adapted to be situated in the cavity of the head guard or similar apparatus. The detachable flashlight can include a second electrical contact and a second magnet. The first magnet is sized and positioned to, and has a magnetic strength sufficient to, orient a rear face of the detachable flashlight to align the second electrical contact of the detachable flashlight with the second electrical contact positioned in the cavity.

Further, in some embodiments, the detachable flashlight can be sized and positioned such that, when situated in the cavity, the second magnet magnetically couples to the first magnet, causing the second electrical contact to align with and electrically couple to the first electrical contact. In further embodiments, a flashlight receiver can be integrally formed in the head guard, where the cavity is defined in the flashlight receiver.

In some embodiments, the detachable flashlight can include a first battery while the headlamp includes a power supply housing having a second battery, where the first battery is different than the second battery. The headlamp can be disposed on a rear portion of the headlamp in some embodiments. The headlamp can include processing circuitry electrically coupled to the second battery, where the processing circuitry is configured to provide power to or charge the first battery of the detachable flashlight in an instance in which the detachable flashlight is situated in the cavity.

In some embodiments, the receiver cavity can further include a presence sensor configured to identify a presence of the detachable flashlight in the receiver cavity. As such, the processing circuitry of the headlamp can provide power to or charge the first battery of the detachable flashlight in response to the presence sensor identifying the presence of the detachable flashlight.

The detachable flashlight can further include processing circuitry configured to toggle between different modes of operation. For example, the different modes of operation can include at least one of: pulsating a light source of the detachable flashlight, providing a constant light from the light source, varying the color of the light source, or varying the luminous intensity of the light source.

While the detachable flashlight can operate as a light source of the head guard, for instance, when the detachable flashlight is stationed in the cavity or otherwise positioned on the head guard, in various embodiments, the head guard may have a source of illumination independent of that of the detachable flashlight. For instance, in some embodiments, the head guard includes one or more light emitting elements (e.g., light emitting diodes) that are turned on when the detachable flashlight is removed from the head guard and turned off when the detachable flashlight is attached or otherwise coupled to the head guard. As such, the processing circuitry of the head guard may be configured to toggle the light emitting elements of the head guard, for instance, based on a signal from the presence sensor indicating the presence or lack of presence of the detachable flashlight on the head guard.

In the following discussion, a general description of a headlamp or other device having a detachable flashlight is provided, followed by a discussion of operation of the same.

Referring now to the drawings, a portion of a headlamp 100 having a detachable flashlight 105 is shown in FIG. 1 according to various embodiments. Specifically, a head guard 110 of the headlamp 100 is shown while additional components of the headlamp 100, such as head straps and a power supply, are not shown for explanatory purposes. Beyond the detachable flashlight 105 and the head guard 110, the headlamp 100 can include a flashlight receiver 115, receiver housing 120, pivoting knobs 125*a*, 125*b* (collectively "pivoting knobs 125"), as well as other components as will be described.

The head guard 110 is adapted to be worn on a head of an operator. For instance, a body 128 of the head guard 110 can be ergonomically countered to fit on or near a forehead of an individual, or on a front of a helmet. As such, the headlamp 100 can provide an operator with a hands-free source of lighting for various uses. However, in some situations, it is beneficial to have a hand-held source of light. For instance, a hand-held flashlight can provide a better source of light in hard-to-reach places, or in various cavities and workspaces. As such, the detachable flashlight 105 can be detached from the head guard 110 such that the detachable flashlight 105 can be operated as a hand-held source of light similar to a traditional flashlight.

To facilitate the removability and independent operation of the detachable flashlight 105, the detachable flashlight 105 can include a power source independent of the headlamp 100. For instance, in some embodiments, the detachable flashlight 105 can include one or more batteries that permit the detachable flashlight 105 to power one or more light sources, such as light emitting diodes (LEDs), independent of a power supply or other light source of the headlamp 100.

The detachable flashlight 105 can further include a flashlight housing 130. In some embodiments, the flashlight housing 130 can include a longitudinally extending and substantially tubular housing, as shown in FIG. 1. Further, the flashlight housing 130 can include one or more ridges 135 in various regions of the flashlight housing 130 that facilitate gripping the detachable flashlight 105. The ridges 135 are shown in a central region of the flashlight housing 130 in the embodiment of FIG. 1. However, the ridges 135 can be positioned on other suitable portions of the flashlight housing 130. The flashlight housing 130 can include a housing base 140 which can be positioned or housed in the flashlight receiver 115, for instance, when the headlamp 100 is used as a hands-free source of light.

In alternative embodiments, the detachable flashlight 105, as opposed to the head guard 110, can include a cavity, where a projecting portion of the head guard 110 is nested in the cavity, as opposed to what is shown in FIG. 1.

The detachable flashlight 105 can further include a switch 145 and processing circuitry (not shown). The processing circuitry can include an integrated circuit (IC) or a microcontroller in some examples. Through operation of the processing circuitry, the switch 145 can toggle the light source and/or mode of operation of the detachable flashlight 105. For instance, in some embodiments, the switch 145 can be manipulated by the operator to turn the light source on or off. In addition to or in lieu of toggling the light source, the switch 145 can iterate through different modes of operation. The different modes of operation can include, for example, pulsating the light source (e.g., performing a strobe effect), providing a constant light source typical to a flashlight, varying the color of the light source, varying the luminous intensity of the light source, or other operation as can be appreciated.

Additionally, the detachable flashlight 105 can include a bezel 150, a lens 158, a reflector (not shown), a light source, as well as other components not described herein. In some embodiments, the bezel 150 can include a circumference greater than that of the flashlight housing 130, as shown in FIG. 1. Further, the light source can include one or more light bulbs or LEDs in some embodiments.

Figure 13:
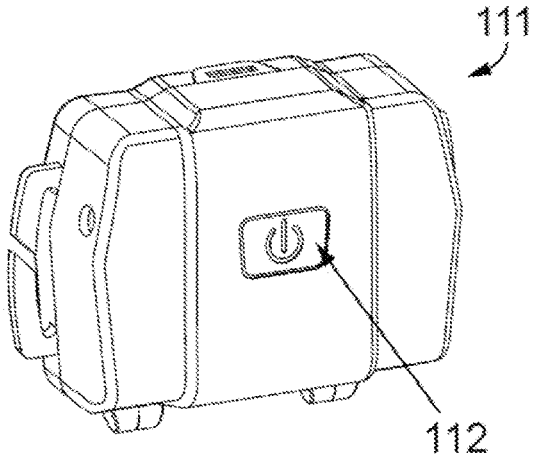
FIG. 13 is a perspective view of an embodiment of a battery pack for use with the detachable flashlight and the head guard of FIG. 1 in accordance with various embodiments of the present disclosure.

In various embodiments, the headlamp 100 may be electrically coupled to a battery pack 111, shown in FIG. 13, using a wire or similar connection. The battery pack 111 may act as a second power source independent of the battery of the detachable flashlight 105 and, as such, may include one or more batteries positioned therein that permit the detachable flashlight 105 to power one or more light sources, such as LEDs. The battery pack 111 can include a power button 112 that toggles the detachable flashlight 105, for instance, when the detachable flashlight 105 is attached to the head guard 110.

Figure 2:
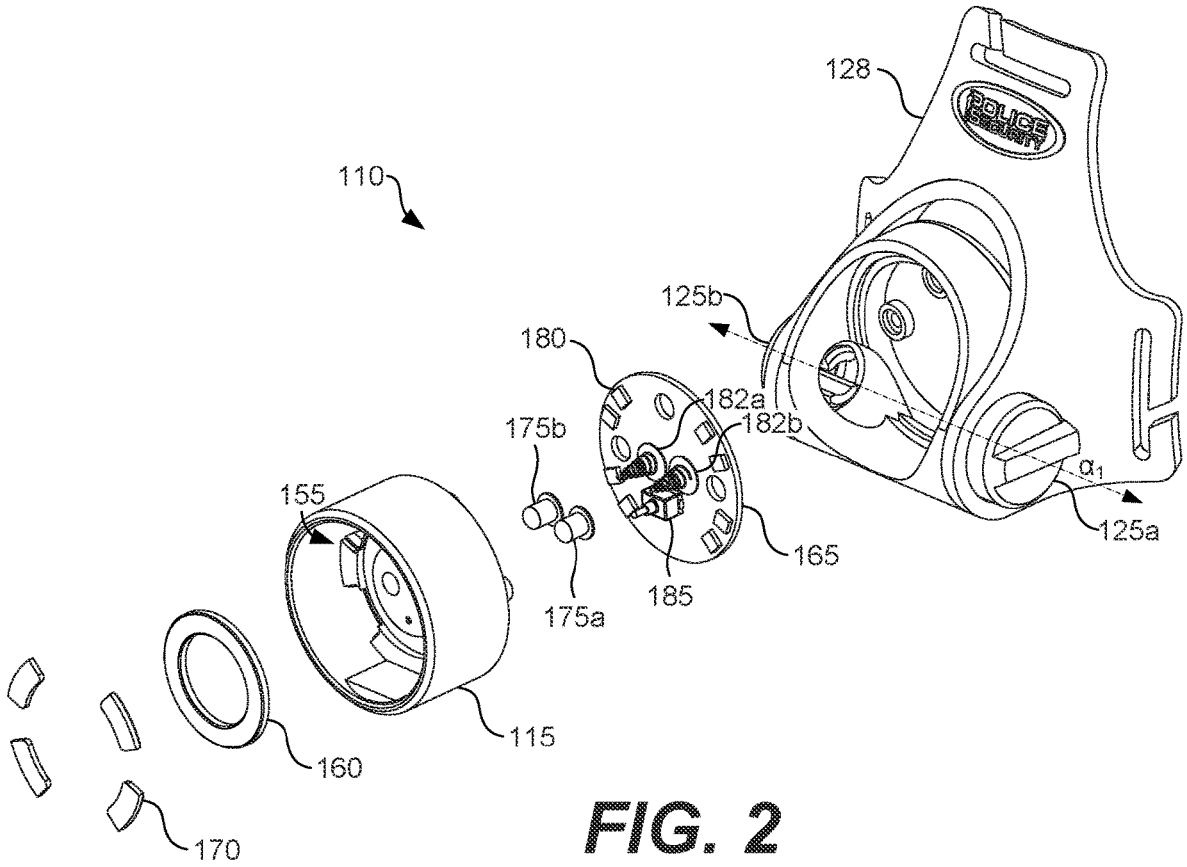
FIG. 2 is an exploded, perspective view of the head guard of FIG. 1 in accordance with various embodiments of the present disclosure.

Referring now to FIG. 2, an exploded, perspective view of the head guard 110 of FIG. 1 is shown in accordance with various embodiments of the present disclosure. Notably, the exploded view of the head guard 110 shows the flashlight receiver 115 separated from the body 128 of the head guard 110 for explanatory purposes. FIG. 2 further illustrates that the flashlight receiver 115 can include a receiver cavity 155 in which the detachable flashlight 105 can be retained. More specifically, the housing base 140 of the detachable flashlight 105 can be positioned in the receiver cavity 155 such that the housing base 140 is situated and retained therein through a slight interference or friction fit, in place of or in addition to a magnetic coupling, as will be discussed.

Figure 6:
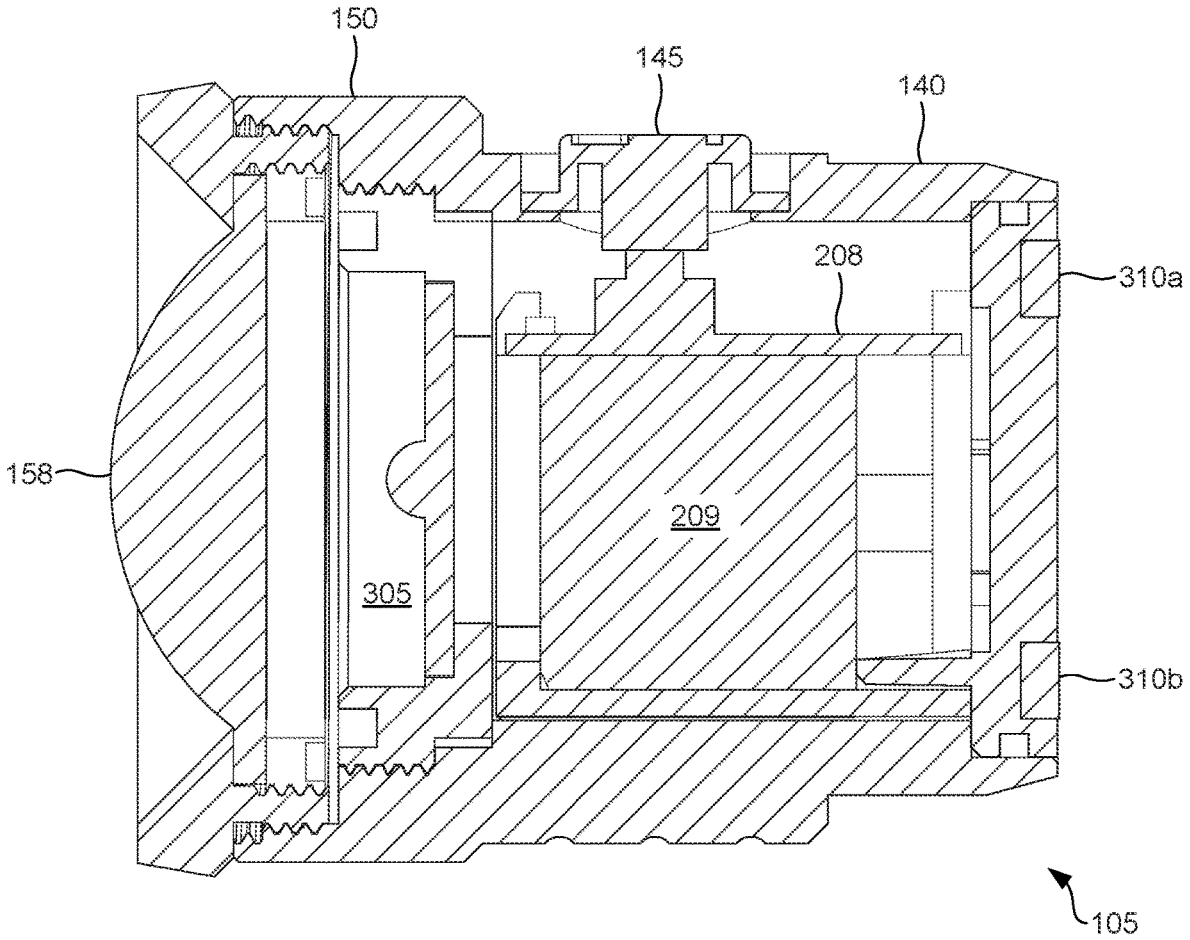
FIG. 6 is a side cross-section of the detachable flashlight of FIG. 1 in accordance with various embodiments of the present disclosure.

To form a slight interference or friction fit, the flashlight receiver 115 can include a shape that substantially conforms to a shape of the housing base 140 of the detachable flashlight 105. For instance, assuming the housing base 140 of the detachable flashlight 105 includes a generally circular body with flat top and bottom portions, as shown in FIG. 6, the flashlight receiver 115 can also include a generally circular body with flat top and bottom portions, as shown in FIG. 2.

Referring collectively to FIGS. 1 and 2, in various embodiments, the housing base 140 can be retained in the receiver cavity 155 such that any torque or force applied on a distal top portion or a distal bottom portion of the detachable flashlight 105 can cause the flashlight receiver 115 to pivot about an axis $\alpha_1$. Notably, pivoting occurs without causing the detachable flashlight 105 to disengage from the head guard 110. Additionally, the pivoting knobs 125 can be turned by the operator in a clockwise or counter-clockwise direction, or otherwise manipulated, to pivot the flashlight receiver 115 and the detachable flashlight 105 positioned therein about the axis $\alpha_1$.

The headlamp 100 can further include a housing magnet 160, a circuit board 165, one or more lenses 170*a* . . . 170*n* (collectively "lenses 170"), and electrical contacts 175*a*, 175*b* (collectively "electrical contacts 175"). The housing magnet 160 can be positioned in the flashlight receiver 115 such that, when the detachable flashlight 105 is positioned in the receiver cavity 155, a magnetic coupling between a magnet of the detachable flashlight 105 and the housing magnet 160 is formed. As can be appreciated, the magnetic coupling retains the detachable flashlight 105 in the receiver cavity 155 until a predetermined amount of force is applied to remove the detachable flashlight from the receiver cavity 155. In some embodiments, the housing magnet 160 includes an annular- or circular-shaped magnet positioned along the interior perimeter of the flashlight receiver 115. However, other shapes and sizes of housing magnets 160 can be employed, such as those shown in FIG. 10.

Referring again to FIG. 2, the circuit board 165 can include a printed circuit board (PCB), an IC, or a combination thereof. In some embodiments, the circuit board 165 is electrically coupled to one or more housing light sources 180, which can include secondary illumination sources independent of the detachable flashlight 105. In some embodiments, the housing light sources 180 can be disposed on the substrate of the circuit board 165. The housing light sources 180 can include, for instance, one or more LEDs positioned annularly around a perimeter of the circuit board 165 or in another suitable arrangement. The lenses 170 can be clear, transparent, or partially transparent, and can be positioned in the receiver cavity 155 such that light emitted by the housing light sources 180 are visible, for instance, when the detachable flashlight 105 is removed from the receiver cavity 155. As such, the head guard 110 can provide light independent of the detachable flashlight 105 in some embodiments.

As the housing light sources 180 can be disposed on the substrate of the circuit board 165, the housing light sources 180 can be positioned in an aperture or placed relative to a recess such that the housing light sources 180 can emit light through or into the receiver cavity 155. While the detachable flashlight 105 can operate as a light source of the head guard 110, for instance, when the detachable flashlight 105 is stationed in the receiver cavity 155 or otherwise positioned on the head guard 110, in various embodiments, the housing light sources 180 of the head guard 110 can act as a source of illumination independent of that of the detachable flashlight 105. To this end, the housing light sources 180 can be engaged or turned on when the detachable flashlight 105 is removed from the head guard 110 and turned off when the detachable flashlight 105 is attached or otherwise coupled to the head guard 110. As such, the processing circuitry of the circuit board 165, or other circuitry of the headlamp 100, may be configured to toggle the housing light sources 180, for instance, based on a signal from the presence sensor 185 indicating the presence or lack of presence of the detachable flashlight 105 in the receiver cavity 155 of the head guard 110.

Additionally, the circuit board 165 can include terminals 182*a*, 182*b* (collectively "terminals 182") and a presence sensor 185. In some embodiments, the terminals 182*a*, 182*b* can include a positive terminal and a negative terminal, respectively, or vice versa. Additionally, the terminals 182 can include multiple positive, ground, or negative terminals 182. The electrical contacts 175*a*, 175*b* can be positioned on respective ones of the terminals 182*a*, 182*b* such that the electrical contacts 175*a*, 175*b* engage with corresponding electrical contacts 178*a*, 178*a* (collectively "electrical contacts 178") positioned on the detachable flashlight 105, thereby forming an electrical connection. The electrical contacts 178*a*, 178*b* are more apparent in the cross-section of the detachable flashlight 105 shown in FIG. 7 and the rear view of the detachable flashlight 105 shown in FIG. 8. Referring back to FIG. 2, through the electrical connection, the detachable flashlight 105 can be powered directly by a power supply of the headlamp 100 or a battery of the detachable flashlight 105 that can be charged and re-charged.

Figure 11:
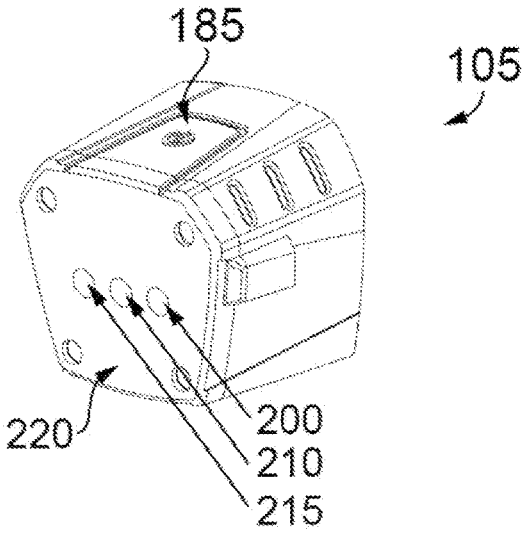
FIG. 11 is a rear view of an embodiment of the detachable flashlight of FIG. 1 in accordance with various embodiments of the present disclosure.
Figure 12:
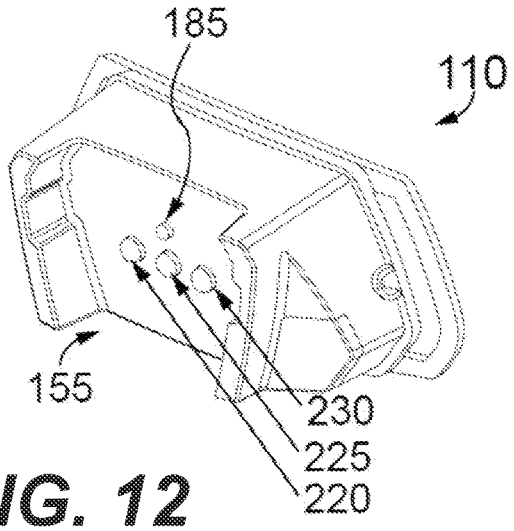
FIG. 12 is a front view of an embodiment of the head guard of FIG. 1 in accordance with various embodiments of the present disclosure.

Referring now to FIGS. 11 and 12, in some embodiments, the detachable flashlight 105 may include three electrical contacts (or other suitable amount of electrical contacts), such as a positive (+) contact 200, a signal contact 210, and a negative contact 215, as shown in FIG. 11, which may align with a corresponding positive terminal 220, a signal terminal 225, and a negative terminal 230 of a head guard 110, as shown in FIG. 12. The signal contact 210 of the detachable flashlight 105 may receive an electrical signal from processing circuitry and/or the battery pack 111 to the detachable flashlight 105 when the detachable flashlight 105 is docked in the receiver cavity 155 or other mount. This allows the user to control the functions of the detachable flashlight 105 (such as a high luminous intensity, low luminous intensity, flashing or strobing light, etc.) from the button 112 on the battery pack 111, in addition to the switch 145 positioned on the detachable flashlight 105. When the detachable flashlight 105 is not positioned in the receiver cavity 155 or otherwise docked, and the secondary source of illumination of the head guard 110 source is activated (e.g., housing light sources 180), the button 112 on the battery pack 111 (see FIG. 13) can also toggle the secondary illumination on and off. Further, in other embodiments, additional electrical signal contacts may be implemented to improve user interaction and interface with the headlamp 100.

Referring back to FIG. 2, the presence sensor 185 can include a mechanical, optical, or other suitable sensor for detecting a presence of the detachable flashlight 105 in the receiver cavity 155, or a lack thereof. For instance, the presence sensor 185 can trigger the housing light source 180 to turn on when the detachable flashlight 105 is removed from the receiver cavity 155, or to turn off when the detachable flashlight 105 is returned or otherwise positioned in the receiver cavity 155.

Figure 3:
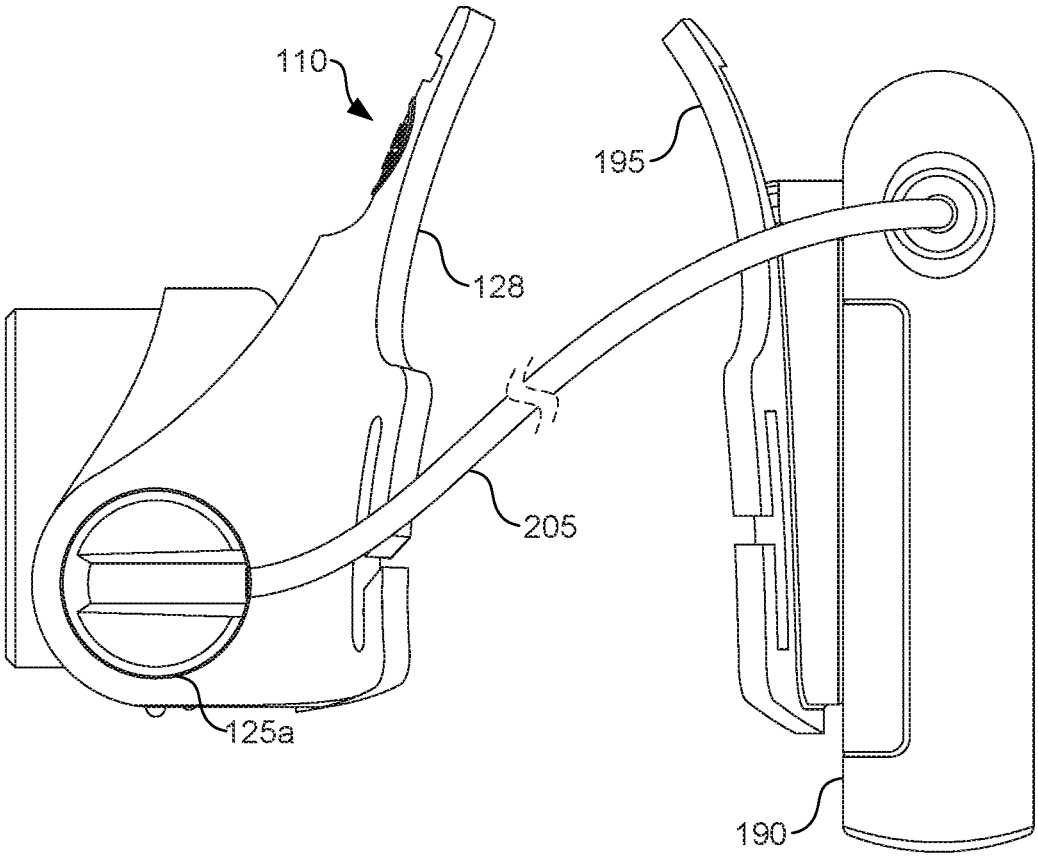
FIG. 3 is a side view of the head guard of FIG. 1 electrically coupled to a power supply in accordance with various embodiments of the present disclosure.

Moving along to FIG. 3, a side view of the head guard 110 is shown being electrically coupled to a power supply housing 190 in accordance with various embodiments of the present disclosure. As noted above, the head guard 110 may be positioned on a forehead, or a front portion of a helmet or hat of an operator. In some embodiments, a power supply housing 190 can be positioned on a rear portion of a head or a helmet of an operator via a rear head guard 195. As can be appreciated, the head guard 110 and the rear head guard 195 can be coupled to one another via one or more straps, which are not shown for explanatory purposes.

The power supply housing 190 can include one or more batteries stored therein. The power source can thus power circuitry of the head guard 110 as well as the light source and circuitry of the detachable flashlight 105, for instance, when the detachable flashlight 105 is positioned in the receiver cavity 155. Additionally, the batteries of the power supply housing 190 can be employed to recharge a battery (not shown) of the detachable flashlight 105. In some embodiments, the power source of the power supply housing 190 is electrically coupled to the head guard 110 via a wire 205 or other suitable electrical connection means. As such, a power source in the power supply housing 190 can be described as being coupled to the circuit board 165 of the head guard 110, as shown in FIG. 2.

Figure 4:
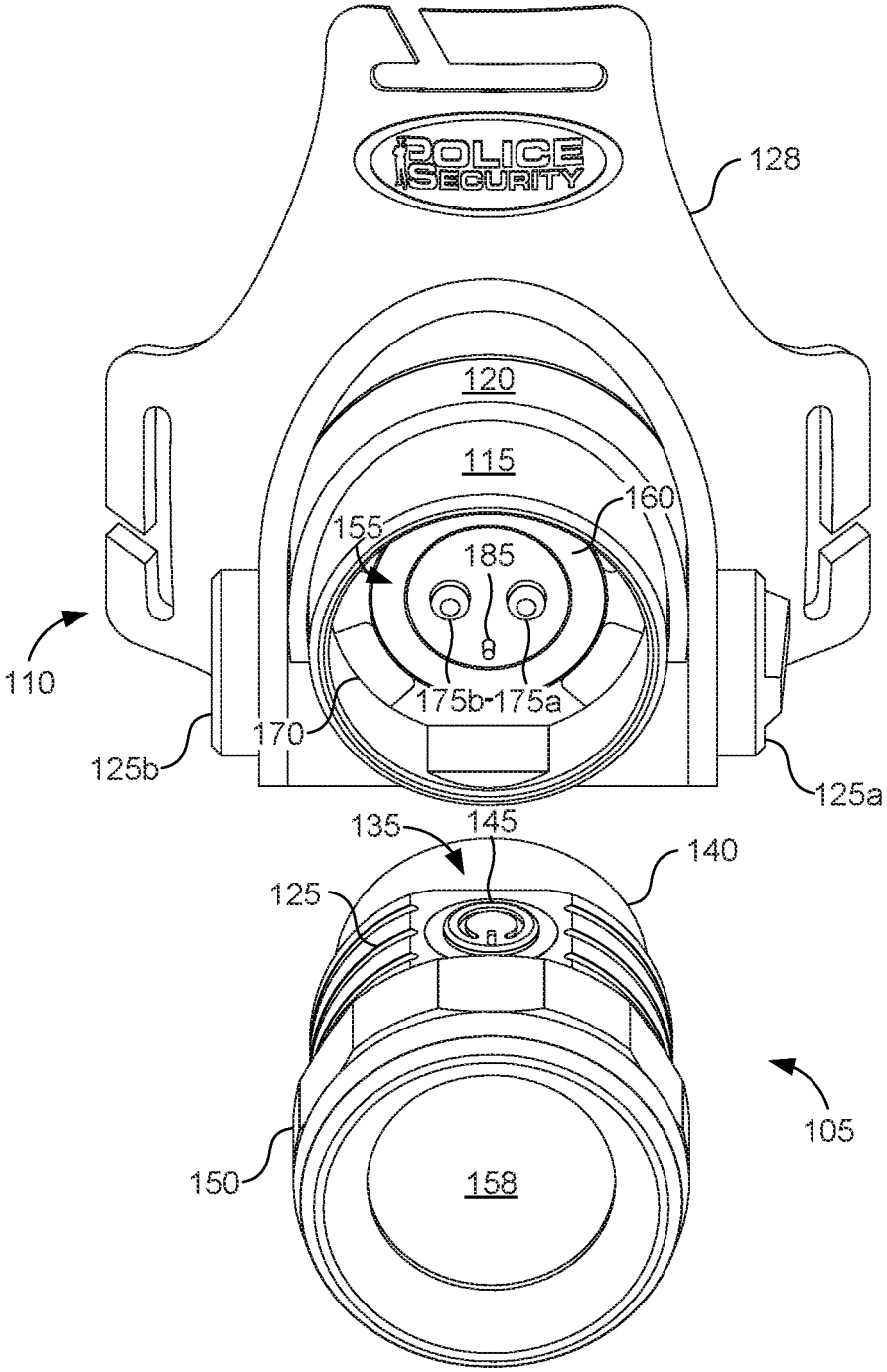
FIG. 4 is a front perspective view of the head guard and the detachable flashlight of FIG. 1 in accordance with various embodiments of the present disclosure.
Figure 5:
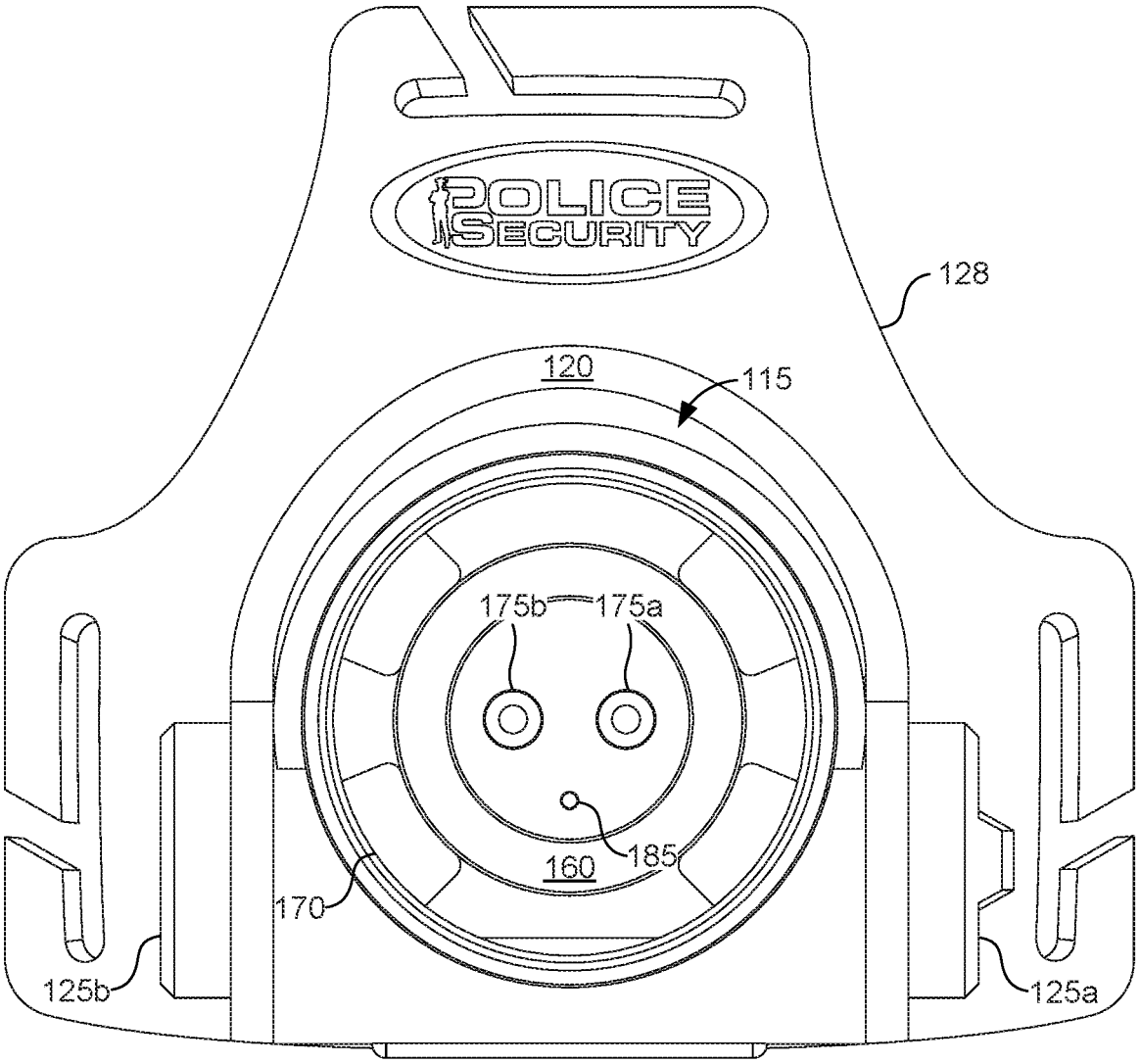
FIG. 5 is a front view of the head guard of FIG. 1 in accordance with various embodiments of the present disclosure.

Turning now to FIGS. 4 and 5, a front perspective view and a front elevation view of the head guard 110 and the detachable flashlight 105 are shown, respectively, in accordance with various embodiments of the present disclosure. The receiver cavity 155 is shown as having the housing magnet 160, the electrical contacts 175*a*, 175*b*, the presence sensor 185, and the lenses 170. The electrical contacts 175*a*, 175*b* can engage with corresponding electrical contacts 178*a*, 178*b* positioned on a rear face of the detachable flashlight 105, as will be shown, thereby forming an electrical connection. Through the electrical connection, the detachable flashlight 105 can be powered directly by a power supply of the headlamp 100, such as one or more batteries stored in the power supply housing 190. In addition to or in place of powering the detachable flashlight 105 directly, one or more batteries of the detachable flashlight 105 can be charged and re-charged.

The head guard 110 can provide light independent of the detachable flashlight 105 in some embodiments. For instance, as shown in FIG. 2, the circuit board 165 can include one or more LEDs or other light sources. As the lenses 170 can be transparent or partially transparent, the lenses 170 are positioned in the receiver cavity 155 such that light emitted by housing light sources 180 are visible, for instance, when the detachable flashlight 105 is removed from the receiver cavity 155.

FIG. 6 is a side cross-section of the detachable flashlight 105 in accordance with various embodiments of the present disclosure. The cross-section of the detachable flashlight 105 further illustrates the flashlight housing 130. In some embodiments, the flashlight housing 130 can include a longitudinally extending and substantially tubular housing. The flashlight housing 130 can include a housing base 140 which can be positioned or housed in the flashlight receiver 115, for instance, when the headlamp 100 is used as a hands-free source of light.

The detachable flashlight 105 further includes a switch 145 and processing circuitry 208, which can be positioned in an interior of the detachable flashlight 105 along with a battery 209, multiple batteries 209, or other power sources. Additionally, the detachable flashlight 105 can include a bezel 150, a lens 158, an LED board 305, a light source, a reflector (not shown), as well as other components not described herein. The light source can include one or more light bulbs or LEDs positioned on the LED board 305 in some embodiments. FIG. 6 further illustrates a cross-section of a flashlight magnet 310*a*, 310*b* which, in some embodiments, can be positioned on a rear face of the detachable flashlight 105.

Figure 7:
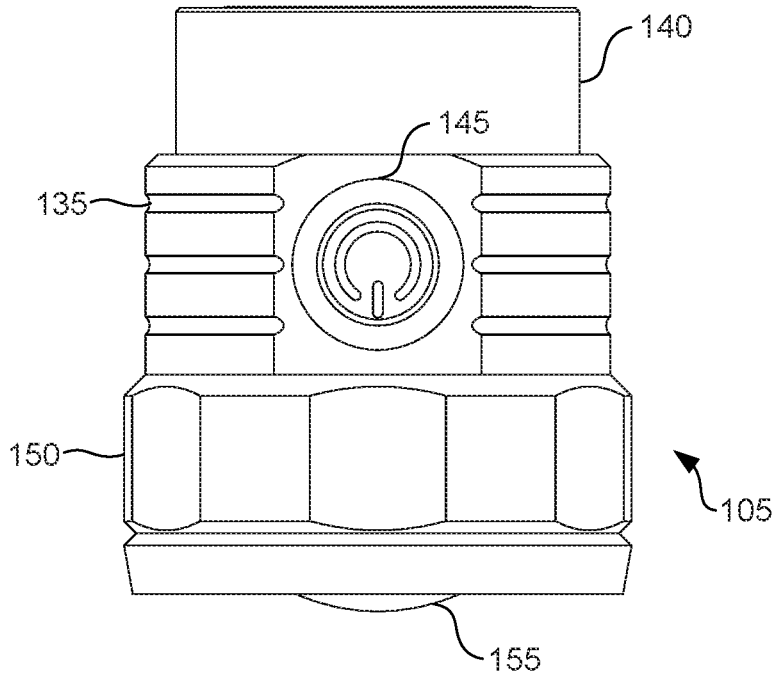
FIG. 7 is a top elevation view of the detachable flashlight of FIG. 1 in accordance with various embodiments of the present disclosure.
Figure 8:
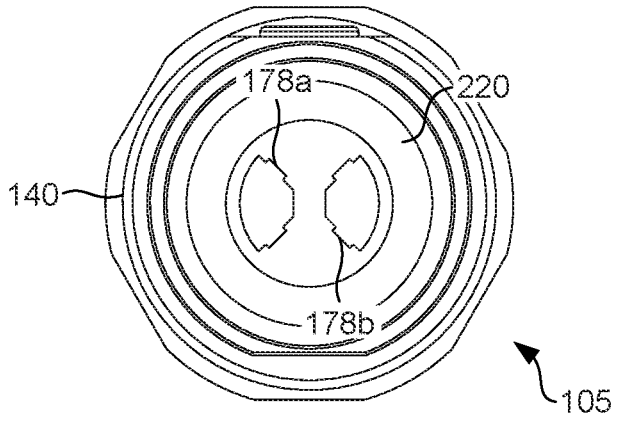
FIG. 8 is rear view of the detachable flashlight of FIG. 1 in accordance with various embodiments of the present disclosure.

Moving on to FIGS. 7 and 8, FIG. 7 shows a top elevation view of the detachable flashlight 105 and FIG. 8 shows a rear view of the detachable flashlight 105 in accordance with various embodiments of the present disclosure. The electrical contacts 178*a*, 178*b* are shown in the cross-section of the detachable flashlight 105, illustrated in FIG. 7, and the rear view of the detachable flashlight 105, shown in FIG. 8. Through the electrical contacts 178, the detachable flashlight 105 can be powered directly by a power supply of the headlamp 100 and/or a battery of the detachable flashlight 105 can be charged and re-charged.

Figure 9:
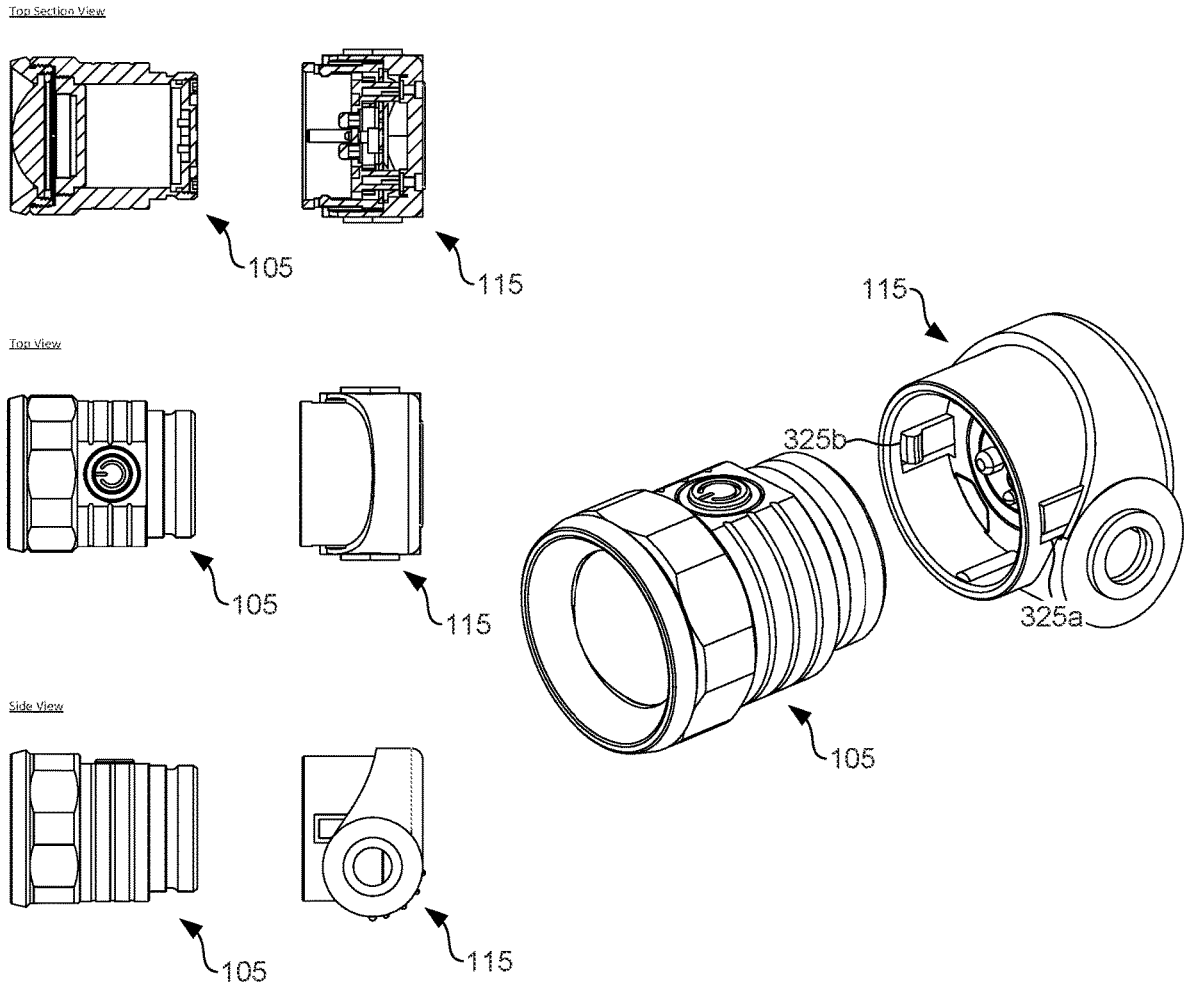
FIG. 9 includes various views of the detachable flashlight of FIG. 1 and a flashlight receiver in accordance with various embodiments of the present disclosure.

FIG. 9 includes various views of the detachable flashlight 105 and the flashlight receiver 115 in accordance with various embodiments of the present disclosure. In some embodiments, the flashlight receiver 115 can include one or more cantilever snap-locking mechanisms 325*a*, 325*b* (collectively "cantilever snap-locking mechanisms 325"). The cantilever snap-locking mechanisms 325*a*, 325*b* can further retain the detachable flashlight 105 in the flashlight receiver 115. However, in other embodiments, additional connection mechanisms, such as varying types of mechanical snap-in mechanisms, may be employed to secure the detachable flashlight 105 to the head guard 110 or other mount.

Figure 10:
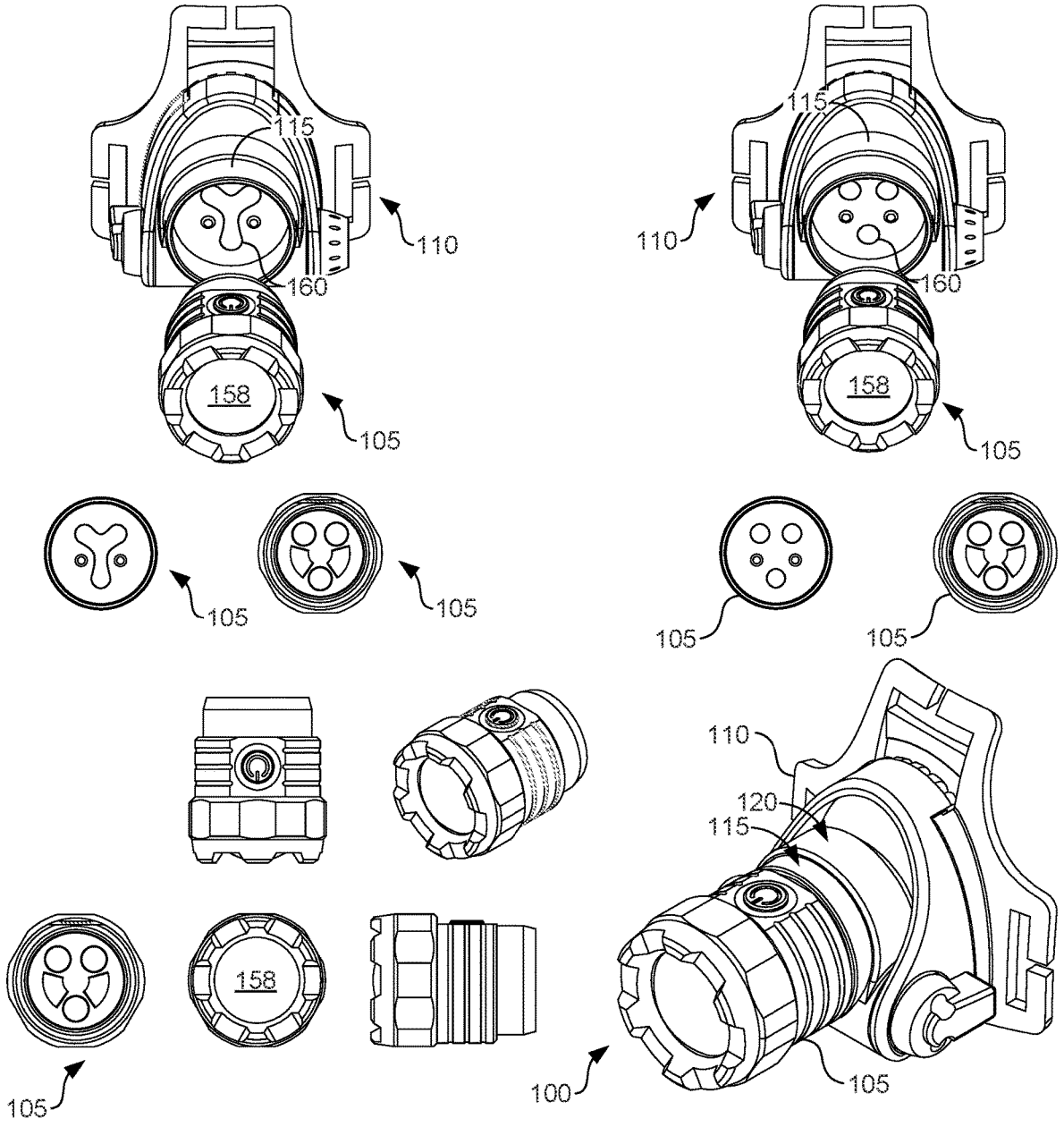
FIG. 10 also includes various views of the detachable flashlight and the head guard of FIG. 1 in accordance with various embodiments of the present disclosure.

FIG. 10 also includes various views of the detachable flashlight 105 and the head guard 110 of FIG. 1 in accordance with various embodiments of the present disclosure. The detachable flashlight 105 can magnetically couple to the electrical contacts 175*a*, 175*b*. The housing magnets 160 can be arranged in an isosceles triangular pattern, as illustrated in FIG. 10. The electrical contacts 175*a*, 175*b* can include a conductive plate (e.g., a metal plate) that corresponds with patterned magnets positioned on a rear of the detachable flashlight 105. This connection mechanism allows for the detachable flashlight 105 to easily connect to the electrical contacts 175*a*, 175*b*, and in the correct orientation.

Referring again to FIGS. 11 and 12, a rear view of an embodiment of the detachable flashlight 105 and a front view of an embodiment of the head guard 110 are shown in accordance with various embodiments of the present disclosure. Again, the detachable flashlight 105 may include three electrical contacts (or other suitable amount of electrical contacts), such as a positive (+) contact 200, a signal contact 210, and a negative contact 215, as shown in FIG. 11. These electrical contacts may align with corresponding a positive terminal 220, a signal terminal 225, and a negative terminal 230, respectively, of the head guard 110 shown in FIG. 12. Further, when the detachable flashlight 105 of FIG. 11 is positioned in the receiver cavity 155 of the head guard 110 of FIG. 12, the presence sensor 185 may be pushed in or otherwise activated (e.g., using an electrical signal, radar, or other type of presence sensor).

The signal contact 210 of the detachable flashlight 105 may receive an electrical signal from processing circuitry and/or the battery pack 111 to the detachable flashlight 105 when the detachable flashlight 105 is docked in the receiver cavity 155 or other mount. Accordingly, the operator of the headlamp 100 may control the functions of the detachable flashlight 105, such as switching between a high luminous intensity mode of operation, low luminous intensity mode of operation, flashing or strobing light mode of operation, or other mode of operation using the button 112 on the battery pack 111. Also, the switch 145 of the detachable flashlight 105 may be toggled to perform the same or similar functions. When the detachable flashlight 105 is not positioned in the receiver cavity 155 or otherwise docked, and the secondary source of illumination of the head guard 110 source is activated (e.g., housing light sources 180), the button 112 on the battery pack 111 can also toggle the secondary illumination on and off. Further, in other embodiments, additional electrical signal contacts may be implemented to improve user interaction and interface with the headlamp 100.

Figure 14:
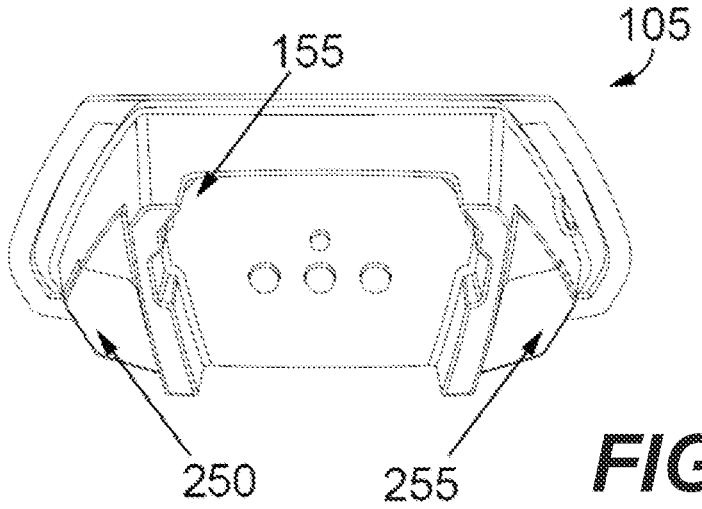
FIG. 14 is a front perspective view of an embodiment of the head guard of FIG. 1 in accordance with various embodiments of the present disclosure.

Moving on to FIG. 14, a front perspective view of an embodiment of the head guard 110 is shown in accordance with various embodiments of the present disclosure. In various embodiments, a secondary illumination of the head guard 110 (independent of a first illumination using the detachable flashlight 105) is not located in the receiver cavity 155, but is instead positioned prominently on a front of the head guard 110. For instance, a first light source 250 is positioned on a left side of the head guard 110 whereas a second light source 255 is positioned on a right side of the head guard 110. The receiver cavity 155 is located between two projections, where each of the projections are directly adjacent to the first light source 250 and the second light source 255, respectively. As such, the secondary illumination can be positioned in any suitable location on the head guard 110.

Figure 15:
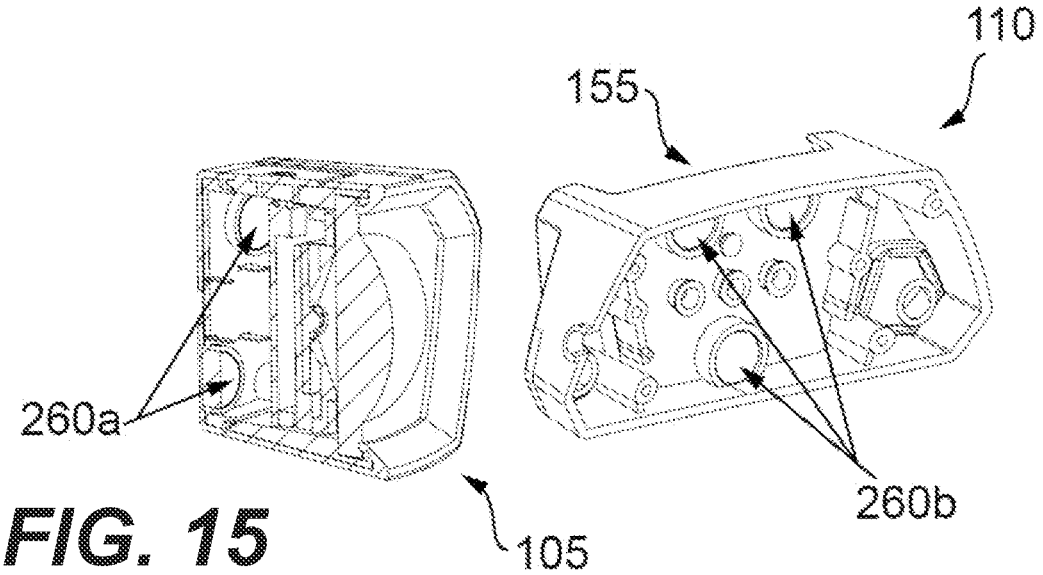
FIG. 15 is a rear cross-sectional view of an embodiment of the detachable flashlight and the head guard of FIGS. 11 and 12 in accordance with various embodiments of the present disclosure.

FIG. 15 is a rear cross-sectional view of an embodiment of the detachable flashlight 105 of FIG. 11 and the head guard 110 of FIG. 12 in accordance with various embodiments of the present disclosure. In various embodiments, magnets 260*a*, 260*b* may be embedded behind a face of both the detachable flashlight 105 and the receiver cavity 155 of the head guard 110, respectively. In the embodiment of FIG. 15, the magnets 260*a* of the detachable flashlight 105 include two or other suitable number of magnets 260, whereas the magnets 260*b* of the head guard 110 include three or other suitable number of magnets 260.

Figure 16:
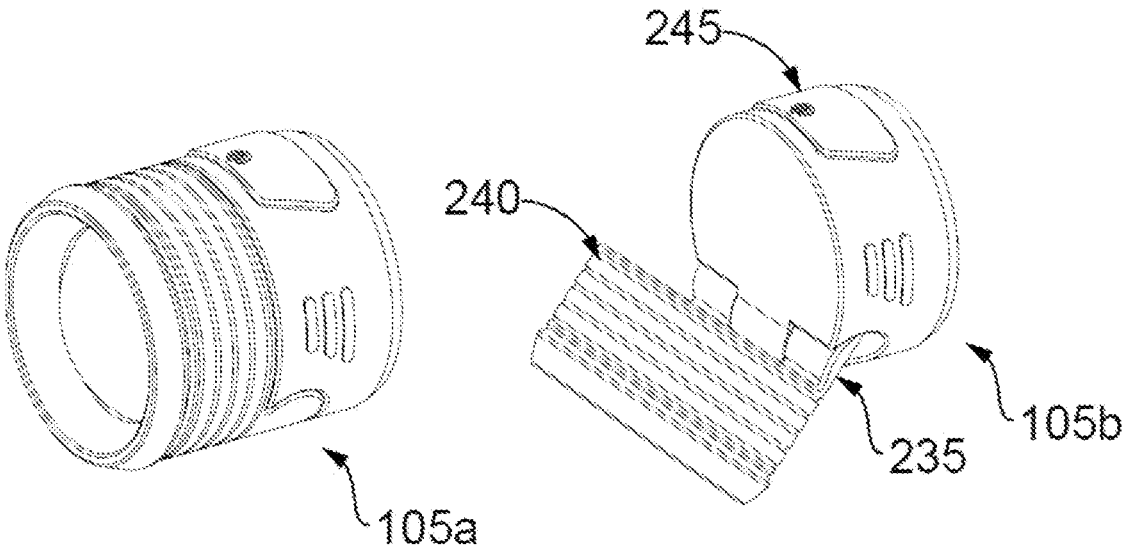
FIG. 16 is a front perspective view of an embodiment of the detachable flashlight of FIG. 1 transitioning between two states in accordance with various embodiments of the present disclosure.

Referring next to FIG. 16, a front perspective view of an embodiment of the detachable flashlight 105*a*, 105*b* of FIG. 1 is shown transitioning between two states in accordance with various embodiments of the present disclosure. In various embodiments, the pivoting mechanism is not incorporated into the receiver cavity 155 of the head guard 110, rather the pivoting mechanism is incorporated into the detachable flashlight 105 itself. For instance, the detachable flashlight 105 may include a hinge 235 that allows a first portion 240 (e.g., a front portion) of the detachable flashlight 105 to pivot relative to a second portion 245 (e.g., a rear or base portion) of the detachable flashlight 105. As such, when the detachable flashlight 105 is positioned in the receiver cavity 155, a downward force may be imposed on the first portion 240 of the detachable flashlight 105, causing the first portion 240 to pivot relative to the second portion 245, where at least a portion of the second portion 245 is retained in the receiver cavity 155 and without causing the detachable flashlight 105 to become disengaged from the head guard 110.

Figure 17:
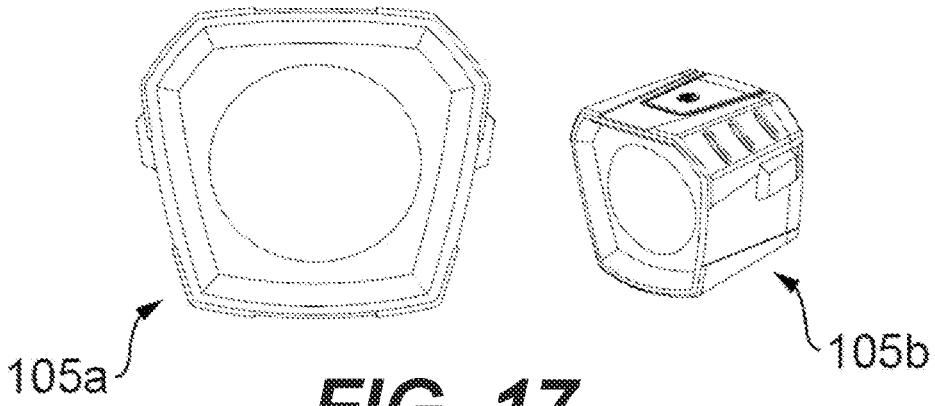
FIG. 17 is a front perspective view of an embodiment of the detachable flashlight of FIG. 1 in accordance with various embodiments of the present disclosure.

FIG. 17 is a front elevation view and a front perspective view of an embodiment of the detachable flashlight 105*a*, 105*b* in accordance with various embodiments of the present disclosure. While the detachable flashlight 105 may include a tubular housing, the disclosure is not so limited. In further embodiments, the detachable flashlight 105 may include a housing having a square, rectangular, or other cross-section. For instance, FIG. 17 shows the detachable flashlight 105 having a hexagonal shape and cross-section (or other polygonal shape and cross-section), where a top of the face of the detachable flashlight 105 is wider than a bottom the face of the detachable flashlight 105.

Figure 18:
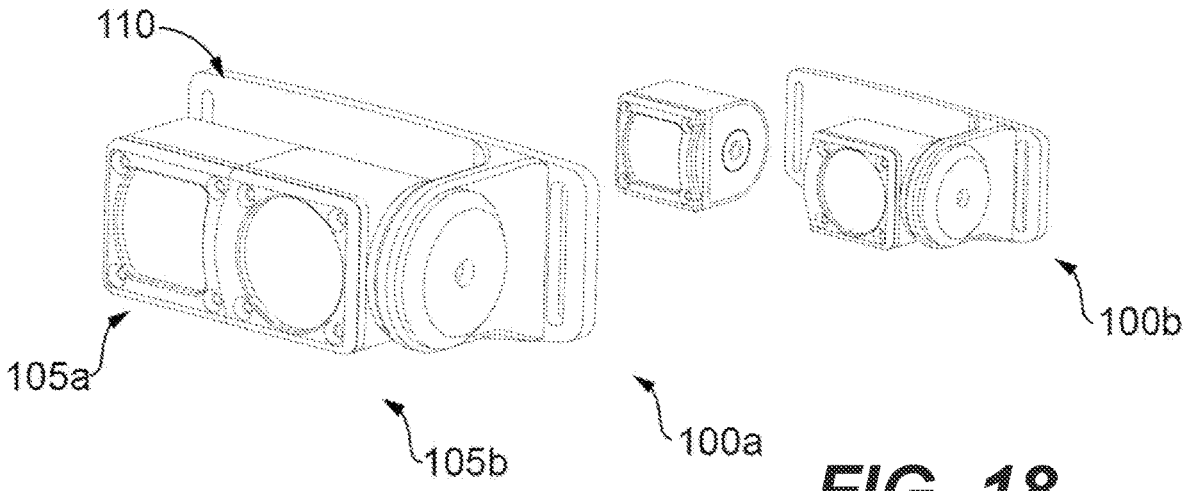
FIG. 18 shows various perspective views of embodiments of the headlamp of FIG. 1 in accordance with various embodiments of the present disclosure.

Turning now to FIG. 18, various perspective views of embodiments of the headlamp 100*a*, 100*b* are shown in accordance with various embodiments of the present disclosure. In some embodiments, the head guard 110 may be configured to receive multiple detachable flashlights 105*a*, 105*b* which may be attached to the head guard 110 in a horizontal or side-by-side arrangement, as shown in FIG. 18, or an up-and-down arrangement (not shown). For instance, a first one of the detachable flashlights 105*a* includes a contoured body that nests or otherwise engages with a second one of the detachable flashlights 105*b*. It is understood that the headlamp 100 may include three sources of illuminations in this embodiment, as the head guard 110 may include lights independent of the of the detachable flashlights 105*a*, 105*b*.

Although relative terms are used in this specification, such as "up" and "down" to describe the relative relationship between one component and another component of an icon, these terms are used in this specification for convenience only, for example according to the directions of the examples described in the drawings. It can be understood that if the device is turned upside down, the component described "up" will become the component "down." When a structure is "on" or "positioned on" another structure, it may mean that a structure is integrally formed on another structure, or that a structure is "directly" arranged on another structure, or that a structure is arranged "indirectly" on another structure through another structure.

The terms "a," "an," "the," and "said" are used to indicate that there are one or more elements, components, etc. The terms "comprising" and "having" are used to indicate open-ended inclusion, and refers to that, in addition to the listed elements, components, etc., there may be other elements, components, etc. The terms "first" and "second" are used only as labels, and are not intended to be a limitation on the number of objects.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A headlamp apparatus, comprising:

a head guard adapted to be worn on a head of an operator, the head guard comprising a receiver comprising a receiver cavity and a first coupling component within the receiver cavity; and a detachable light configured to removably attach to the receiver, the detachable light comprising an illumination source and a second coupling component;

wherein, when the second coupling component is positioned within the receiver cavity near the first coupling component, the detachable light magnetically couples to the receiver to provide a magnetic connection mechanism that secures and aligns the detachable light in a particular orientation within the receiver cavity.

2. The headlamp of claim 1, wherein the illumination source is at least one light-emitting diode.

3. The headlamp of claim 1, further comprising:

a receiver cavity at least partially formed in the receiver;

wherein at least a portion of the detachable light is configured to nest at least partially within the receiver cavity.

4. The headlamp of claim 3, wherein the receiver cavity is configured to frictionally engage the detachable light when the detachable light is magnetically coupled to the receiver.

5. The headlamp of claim 3, wherein:

the head guard is ergonomically contoured to conform to a forehead of the operator; and the head guard comprises at least one strap for securing the head guard to the head of the operator.

6. The headlamp of claim 5, wherein the second coupling component includes a permanent magnet.

7. The headlamp of claim 3, wherein the detachable light can nest within the receiver cavity in a first configuration and second configuration.

8. The headlamp of claim 7, wherein the detachable light is configured to project light in a first direction when in the first configuration and the detachable light is configured to project light in a second direction when in the second configuration.

9. The headlamp of claim 3, wherein the detachable light further comprises a power source.

10. The headlamp of claim 9, wherein the power source is a rechargeable battery.

11. The headlamp of claim 3, wherein the detachable light comprises processing circuitry configured to toggle between different modes of operation, wherein the different modes of operation comprise at least one of: pulsating a light source of the detachable light, providing a constant light from the light source, varying a color of the light source, or varying a luminous intensity of the light source.

12. A lighting apparatus comprising:

a detachable light body having a housing, at least one source of illumination, a power source contained within the housing for selectively powering the at least one source of illumination, and a first coupling component; and a device configured to removably secure the lighting apparatus to a user, the device comprising a receiver comprising a receiver cavity having a second coupling component, and an additional connection mechanism;

wherein, when the first coupling component is positioned within the receiver cavity near the second coupling component, the detachable light body magnetically couples to the receiver to provide a magnetic connection mechanism that secures and aligns the detachable light body in a particular orientation within the receiver cavity.

13. The lighting apparatus of claim 12, wherein the receiver comprises a cavity configured to removably receive at least a portion of the detachable light body therein.

14. The lighting apparatus of claim 13, wherein the first coupling component comprises a permanent magnet.

15. The lighting apparatus of claim 12, wherein the receiver comprises a connection mechanism configured to frictionally engage at least a portion of the housing of the detachable light body when the detachable light body is magnetically coupled to the receiver.

16. The lighting apparatus of claim 12, wherein the receiver comprises a connection mechanism configured to automatically orient the detachable light body in a first configuration when the detachable light body is magnetically coupled to the receiver.

17. The lighting apparatus of claim 12, wherein the detachable light body can be configured to be magnetically coupled to the receiver in a second configuration by the user.

* * * * *